US008757183B2

(12) United States Patent
Volin

(10) Patent No.: US 8,757,183 B2
(45) Date of Patent: Jun. 24, 2014

(54) SOLAR-POWERED PULLEY-ASSISTED UMBRELLA HAVING SIMULTANEOUSLY AND OPPOSITELY MOVABLE TOP-AND-BOTTOM WEIGHTED BRACKETS

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 13 days.

(21) Appl. No.: 13/646,179

(22) Filed: Oct. 5, 2012

(65) Prior Publication Data

US 2014/0096802 A1 Apr. 10, 2014

(51) Int. Cl.
*A45B 25/14* (2006.01)
*A44B 19/08* (2006.01)

(52) U.S. Cl.
USPC ..... 135/20.3; 135/25.4

(58) Field of Classification Search
CPC .. A45B 25/06; A45B 2009/007; A45B 19/04; A45B 19/08
USPC ..... 135/15.1, 20.3, 25.1, 25.4, 28, 38
See application file for complete search history.

(56) References Cited

U.S. PATENT DOCUMENTS

| | | | | |
|---|---|---|---|---|
| 4,424,824 | A * | 1/1984 | Becher | 135/20.3 |
| 4,572,226 | A | 2/1986 | Williams | |
| 4,807,655 | A * | 2/1989 | Robertson | 135/22 |
| 5,213,122 | A | 5/1993 | Grady | |
| 5,291,908 | A | 3/1994 | Grady | |
| 6,058,951 | A | 5/2000 | Wilson | |
| 6,145,522 | A * | 11/2000 | Ko | 135/24 |
| 6,170,497 | B1 * | 1/2001 | Ma | 135/20.3 |
| 6,182,917 | B1 | 2/2001 | Lai | |
| 6,543,464 | B1 | 4/2003 | Grady | |
| 7,188,633 | B2 | 3/2007 | Zerillo | |
| 7,389,784 | B2 * | 6/2008 | Kuo | 135/24 |
| 7,401,615 | B2 * | 7/2008 | Kuo | 135/22 |
| 7,562,666 | B2 | 7/2009 | Chan | |
| 7,997,290 | B2 | 8/2011 | Stoelinga | |
| 8,087,420 | B1 * | 1/2012 | Lukacsy | 135/22 |
| 2006/0151019 | A1 * | 7/2006 | Lo | 135/20.3 |
| 2009/0145469 | A1 * | 6/2009 | Pirlo | 135/16 |
| 2011/0315179 | A1 * | 12/2011 | Glatz et al. | 135/98 |

* cited by examiner

*Primary Examiner* — David R Dunn
*Assistant Examiner* — Danielle Jackson

(57) ABSTRACT

A unique solar-powered, pulley-assisted, simultaneously-and-oppositely-movable-top-and-bottom-weighted-bracket umbrella has movable weighted rib and strut brackets for eliminating the umbrella-operating roughness by having predetermined weights to increase the gravitational forces exerted thereon when they are moving up and down. The umbrella further has an electric motor, a solar panel to collect energy from the sun light, and a circuit-board control center for converting the solar energy into electricity and for regulating the operation and energy management of the electric motor. The umbrella further has lights, a threaded spindle rotated by the motor, pulleys for raising and lowering the weighted rib and strut brackets in opposite directions at the same time to reduce 50% of then travel distances and 50% of their weights, an external electricity storage, and a remote control device for remotely operating the motor and lights.

20 Claims, 7 Drawing Sheets

SOLAR-POWERED PULLEY-ASSISTED UMBRELLA HAVING SIMULTANEOUSLY AND OPPOSITELY MOVABLE TOP-AND-BOTTOM WEIGHTED BRACKETS

FIELD OF THE INVENTION

The invention relates to a motorized umbrella embodying pulley system. Especially, the invention relates to a motorized umbrella embodying solar panel, motor, remote control device, pulley system, lights, and simultaneously and oppositely movable top-and-bottom weighted brackets.

DESCRIPTION OF THE PRIOR ART

A number of inventions of motorized umbrellas have been introduced. U.S. Pat. No. 4,572,226, filed Aug. 9, 1984, to Williams, Gory R.; U.S. Pat. No. 5,213,122, filed Nov. 13, 1990, to Grady, Clyde C.; U.S. Pat. No. 5,291,908, filed Aug. 10, 1992, to Grady, Clyde C.; U.S. Pat. No. 6,058,951, filed Jul. 28, 1998, to Wilson, Robert Joe; U.S. Pat. No. 6,182,917, filed Jun. 2, 1999, to Lai, Jin-Sheng, U.S. Pat. No. 6,543,464, filed Oct. 23, 2000, to Grady, Clyde C; U.S. Pat. No. 7,188, 633, filed Dec. 17, 2003, to Zedllo, Michael A; U.S. Pat. No. 7,562,666, filed Jul. 27, 2006, to Chan, Ping Chin; and U.S. Pat. No. 7,997,290, filed Jan. 2, 2008, to Stoelinga, Dirk J disclose a variety of umbrellas. All the prior-art inventions have failed to solve many inherent problems associated with such umbrellas, as follows:

1) The prior-art umbrellas substantially increase the amount of the time required to fold and unfold the motorized umbrella, electrically.
2) The prior-art umbrellas substantially increase the up-and-down travel distance of one of the top and bottom brackets required to fold and unfold the motorized umbrella, by moving only one of the top and bottom brackets.
3) The prior-art, umbrellas substantially increase the amount of wear and tear exerted upon the components of the umbrella while folding and unfolding the motorized umbrella, electrically.
4) The prior-art umbrellas substantially increase the umbrella-operating roughness caused by one of the top and bottom unweighted brackets while it is moving up and down.
5) The prior-art umbrellas do not integrate the gravitational force into the pushing and pulling forces of the motor of the umbrella during the folding and unfolding of the umbrella, by using the top and bottom unweighted brackets.
6) The prior-art umbrellas substantially increase the up-and-down travel distance of the inner tube of the umbrella, required to fold and unfold the motorized umbrella, which prevents the umbrella to be able to be made taller.
7) The prior-art umbrellas substantially increase the amount of electricity required to fold and unfold the motorized umbrella, electrically.
8) The prior-art umbrellas substantially increase the umbrella-operating unreliability caused by the top and bottom unweighted brackets while they are moving up and down, which shortens the service lifespan of the umbrella.
9) The prior-art umbrellas substantially increase the power and size of its motor required to fold and unfold the umbrella, electrically.
10) The prior-art umbrellas cannot be made substantially larger while using its motor of the same power and size.

OBJECTS AND ADVANTAGES OF THE INVENTION

The unique solar-powered, pulley-assisted, simultaneously-and-oppositely-movable-top-and-bottom-weighted-bracket umbrella overcomes all the disadvantages of the prior art heretofore. The unique solar-powered, pulley-assisted, simultaneously-and-oppositely-movable-top-and-bottom-weighted-bracket umbrella substantially departs from the conventional concepts and designs of the prior art. In doing so, the unique solar-powered, pulley-assisted, simultaneously-and-oppositely-movable-top-and-bottom-weighted-bracket umbrella provides many unique, significant advantages, some of which are, as follows:

1) it is an object of the present invention to provide a unique solar-powered, pulley-assisted, simultaneously-and-oppositely-movable-top-and-bottom-weighted-bracket umbrella which can substantially reduce 50% of the time required to fold and unfold the motorized umbrella, electrically, by using simultaneously and oppositely movable top-and-bottom weighted brackets.
2) it is an object of the present invention to provide a unique solar-powered, pulley-assisted, umbrella, which can substantially reduce 50% of the up-and-down travel distance of the top and bottom weighted brackets required to fold and unfold the motorized umbrella, by moving the top and bottom weighted brackets, simultaneously and oppositely in the opposite directions.
3) It is an object of the present invention to provide a unique solar-powered, pulley-assisted, simultaeously-and-oppositely-movable-top-and-bottom-weighted-bracket umbrella, which can substantially reduce 50% of the amount of wear and tear exerted upon the components of the umbrella while folding and unfolding the motorized umbrella, by replacing the top and bottom unweighted brackets of the prior art with predeterminedly weighted top and bottom brackets, respectively.
4) it is another object of the present invention to provide a unique solar-powered, pulley-assisted, similitaeously-and-oppositely-movable-top-and-bottom-weighted-bracket umbrella, which can eliminate the umbrella-operating roughness caused by the top and bottom unweighted brackets of the prior art while they are moving up and down, by replacing them with predeterminedly weighted top and bottom brackets, respectively.
5) It is another object of the present invention to provide a unique solar-powered, pulley-assisted, simultaneously-and-oppositely-movable-top-and-bottom-weighted-bracket umbrella, which can integrate the gravitational force into the pushing and pulling forces of the motor of the umbrella during the folding and unfolding of the umbrella, by using predeterminedly weighted top and bottom brackets.
6) It is another object of the present invention to provide a unique solar-powered, pulley-assisted, simultaneously-and-oppositely-movable-top-and-bottom-weighted-bracket umbrella, which can substantially reduce 50% of the up-and-down travel distance of the inner tube of the umbrella, required to fold and unfold the motorized umbrella, to allow the umbrella to be able to be made taller.
7) It is an object of the present invention to provide a unique solar-powered, pulley-assisted, simultaneously-and-oppositely-movable-top-and-bottom-weighted-bracket umbrella, which can substantially reduce the amount of electricity required to fold and unfold the motorized umbrella, with the integration of the gravitational force thereinto.
8) it is another object of the present invention to provide a unique solar-powered, pulley-assisted, simultaneously-and-oppositely-movable-top-and-bottom-weighted-bracket umbrella, which can substantially decrease the umbrella-operating unreliability caused by the top and bottom brackets of the prior art while they are moving up and down, by replacing them with predeterminedly weighted top and bottom brackets, respectively, to extend the service lifespan of the umbrella.

9) It is another object of the present invention to provide a unique solar-powered, pulley-assisted, simultaneously-and-oppositely-movable-top-and-bottom-weighted-bracket umbrella, which can reduce 50% of the weights of the weighted rib and strut brackets to substantially reduce the power and size of its motor required to fold and unfold the umbrella, with the integration of the gravitational force thereinto.

10) It is another object of the present invention to provide a unique solar-powered, pulley-assisted, simultaneously-and-oppositely-movable-top-and-bottom-weighted-bracket umbrella, which can substantially be made larger while using its motor of the same power and size.

As a result, the unique solar-powered, pulley-assisted, simultaneously-and-oppositely-movable-top-and-bottom-weighted-bracket umbrella overcomes all the disadvantages of the prior art. These above and additional advantages are described and illustrated in the ensuing specification and illustrations.

SUMMARY OF THE INVENTION

Figure 1:
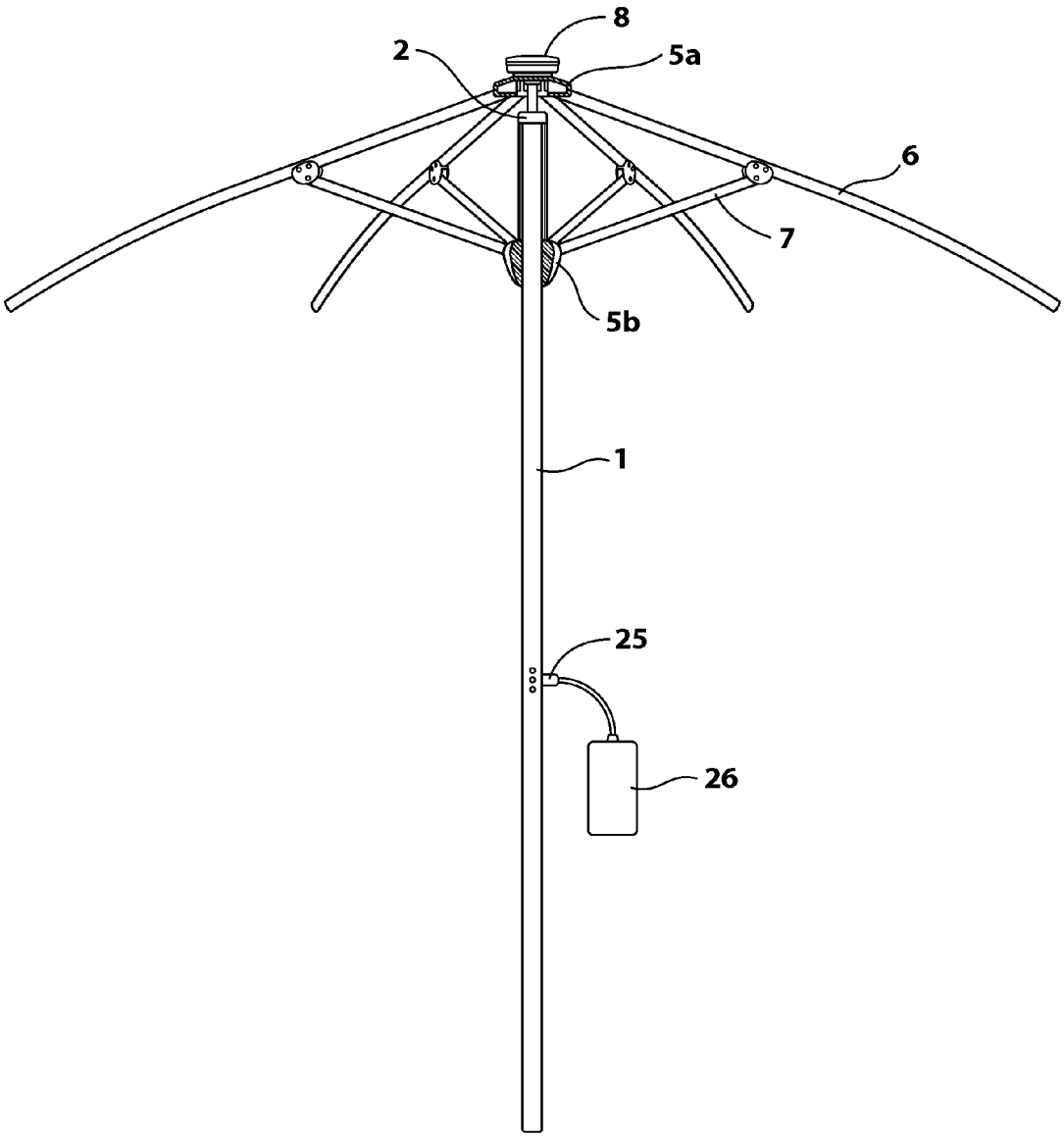
FIG. 1 illustrates a partially-cross-sectional view of a unique solar-powered, pulley-assisted, simultaneously-and-oppositely-movable-top-and-bottom-weighted-bracket umbrella, in an unfolded position.
Figure 2:
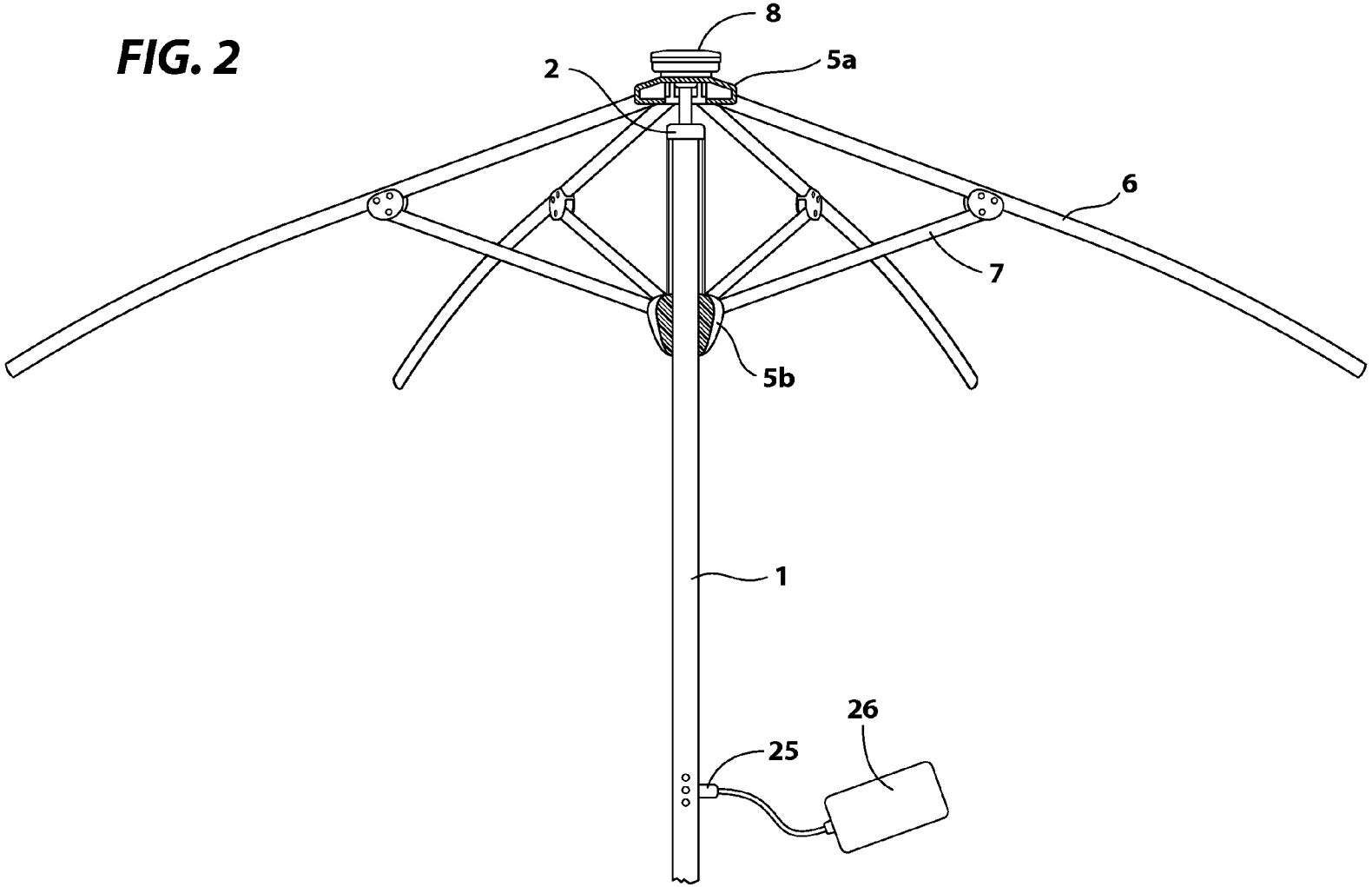
FIG. 2 illustrates a partially-cross-sectional view of the unique solar-powered, pulley-assisted, simultaneously-and-oppositely-movable-top-and-bottom-weighted-bracket umbrella, in an unfolded position.

A unique solar-powered, pulley-assisted, simultaneously-and-oppositely-movable-top-and-bottom-weighted-bracket umbrella has movable weighted rib and strut brackets for eliminating the umbrella-operating roughness by increasing this predetermined weights to increase the gravitational forces exerted thereon when they are moving up and down. The umbrella further has a solar panel and a transparent housing, top for allowing sun light to pass, such that the solar panel can collect energy from the sun light. The umbrella further has an electric motor and a circuit-board control center for converting the solar energy absorbed by the solar panel into electricity, and for regulating the operation and energy management of the electric motor. The umbrella further has lights for illuminating the ground area under the umbrella. The umbrella further has a threaded spindle rotated by the electric motor and pulleys for raising and lowering the movable weighted rib and strut brackets in opposite directions at the same time to reduce 50% of the up-and-down travel distances of the movable weighted rib and strut brackets, and to reduce 50% of their weights. The umbrella further has an external electricity storage and a remote control device for remotely operating the electric motor and the lights.

PREFERRED EMBODIMENT

Structure

Referring to FIGS. 1, 2, 3, and 4, a unique solar-powered, pulley-assisted, simultaneously-and-oppositely-movable-top-and-bottom-weighted-bracket umbrella comprises an Outer tube 1, a fixed pulley bracket 2 having a central hole along its longitudinal axis, an inner tube 3, a spindle nut 4 having a central threaded hole along its longitudinal axis, a movable weighted rib bracket 5*a*, a movable weighted strut bracket 5*b*, a plurality of canopy ribs 6, a plurality of canopy struts 7, a transparent housing top 8, a housing bottom 9, a solar panel 10, a circuit-board control center 11, a remote-control-device-signal receiver 12, a battery 13, a plurality of lights 14, an electric motor 15, a plurality of electric wires 16, an electric port 17, a plurality of control buttons 18, a motor-and-spindle coupling. 19, a threaded spindle 20 having thread mated to the thread of the central hole of spindle nut 4, a plurality of pulleys 21, a plurality of cables 22, a cable tunnel 23, a remote control device 24, an electric prong 25, and an external electricity storage 26.

Material

Each component of the unique solar-powered, pulley-assisted, simultaneously-and-oppositely-movable-top-and-bottom-weighted-bracket umbrella, independently from the other components of the umbrella, can be partially or entirely made of rigid material, semi-rigid material, non-rigid material, flexible material, semi-flexible material, non-flexible material, pliable material, semi-pliable material, non-pliable material, elastic material, semi-elastic material, non-elastic material, resilient material, semi-resilient material, non-resilient material, or a combination of at least two of the above.

For example, any component of the unique solar-powered, pulley-assisted, simultaneously-and-oppositely-movable-top-and-bottom-weighted-bracket umbrella can be made of any of the following materials: nylon, fabric, cotton, plastic, plastic composite, plasticized material, ABC, PVC, fiber class, iron, copper, zinc, bronze, tin, alloy, aluminum, stainless steel, the equivalent, the like, or a combination of at least two of the above.

For example, outer tube 1, fixed pulley bracket 2, inner tube 3, spindle nut 4, movable weighted rib bracket 5*a*, movable weighted strut bracket 5*b*, motor-and-spindle coupling 19, threaded spindle 20, and pulleys 21 can be made of rigid, material, such as stainless steel.

For example, movable weighted rib bracket 5*a* and movable weighted strut bracket 51*b* can be made of rigid material, such as iron.

For example, canopy ribs 6 and canopy struts 7 can be made of semi-rigid material, such as aluminum.

For example, transparent housing top 8 and housing bottom 9 can be made of semi-rigid material, such as plastic.

For example, electric wires 16 can be made of flexible material, such as copper.

For example, control buttons 18 can be made of semi-rigid material, such as plastic.

For example, cables 22 can be made of flexible material, such as plastic-coated weaved steel wire.

Connection

Referring to MS. 1, 2, 3, and 4, each component of the unique solar-powered, pulley-assisted, simultaneously-and-oppositely-movable-top-and-bottom-weighted-bracket umbrella is connected to others, as follows. Fixed pulley bracket 2 is attached to the upper end of outer tube 1; Inner tube 3 is inserted through the central hole of fixed pulley bracket 2 into outer tube 1; Spindle nut 4 is attached to the lower end of inner tube 3; Movable weighted rib bracket 5*a* is attached to the upper end of inner tube 3; Movable weighted strut bracket 5*b* is slid over outer tube 1 such that movable weighted strut bracket 5*b* can move up and down on the outside of outer tube 1; One end of each canopy rib 6 is attached to movable weighted rib bracket 5*a*; One end of each canopy strut 7 is attached to movable weighted strut bracket 5*b*; Another end of each canopy strut 7 is attached to one canopy rib 6 at a predetermined location thereon, respectively; Transparent housing top 8 is attached to housing bottom 9; Solar panel 10 is attached to circuit-board control center 11; Remote-control-device-signal receiver 12 is attached to circuit-board control center 11; Battery 13 is attached to circuit-board control center 11; Lights 14 are attached to circuit-board control center 11; Circuit-board control center 11 is attached to housing bottom 9; Circuit-board control center 11 is attached to motor 15 and control buttons 18 through wires; Housing bottom 9 is attached to movable weighted rib bracket 5*a*; Electric motor 15 is attached to outer tube 1; Electric wires 16 are attached to electric motor 15; Electric port 17 is attached to electric wires 16; Control buttons 18 is wired to electric motor 15; The under surface of motor-and-spindle coupling 19 is attached to electric motor 15; The upper surface of motor-and-spindle coupling 19 is attached to threaded spindle 20; Threaded spindle 20 is screwed upward through the central threaded hole of spindle nut 4; Pulleys 21 are attached to fixed pulley bracket 2 at predetermined locations thereon; One end of each cable 22 is attached to movable weighted strut bracket 5*b* on one side of outer tube 1; Another end of each cable 22 is pulled over one of pulleys 21, threaded through the central hole of fixed pulley bracket 2, threaded through cable tunnel 23 of inner tube 3, pulled over another one of pulleys 21 on the opposite side therefrom, and attached to movable weighted strut bracket 5*b* on the opposite side of outer tube 1; Remote control device 24 is kept separate from the umbrella; and Electric prong 25 is attached to external electricity storage 26.

Function

Referring to FIGS. 1, 2, 3, and 4, each component of the unique solar-powered, pulley-assisted, simultaneously-and-oppositely-movable-top-and-bottom-weighted-bracket umbrella is for performing a function, as follows: Outer tube 1 is for supporting other components of the umbrella, and is for holding the umbrella in an upright position. Fixed pulley bracket 2 is for centering inner tube 3; Inner tube 3 is for raising and lowering movable rib bracket 5*a* and ribs 6; Spindle nut 4 is for raising and lowering inner tube 3; Movable weighted rib bracket 5*a* is for eliminating the roughness of the operation of the umbrella by increasing its predetermined weight to increase the gravitational force exerted thereon when it is moving up and down; Movable weighted strut bracket 5*b* is for eliminating the roughness of the operation of the umbrella by increasing its predetermined weight to increase the gravitational force exerted thereon when it is moving up and down; Canopy ribs 6 are for supporting and spreading the canopy of the umbrella; Canopy struts 7 are for folding and unfolding canopy ribs 6; Transparent housing top 8 is for protecting solar panel 10 and circuit-board control center 11, and is for allowing sun light to pass therethrough; Rousing bottom 9 is for protecting solar panel 10 and circuit-board control center 11; Solar panel 10 is for collecting energy from the sun light; Circuit-board control center 11 is for convening the solar energy absorbed by solar panel 10 into electricity, and is for regulating the operation and energy management of electric motor 15; Remote-control-device-signal receiver 12 is for receiving the operating signal from remote control device 24; Battery 13 is for storing the electricity from solar panel 10, and is for supplying the electricity to electric motor 15; Lights 14 are for illuminating the ground area under the umbrella; Electric motor 15 is for rotating spindle 20 to raise and lower inner tube 3; Electric Wires 16 are for allowing electricity to flow from external electricity storage 26 to electric motor 15; Electric port 17 is for electric prong 25 of external electricity storage 26 to plug therein to connect electric motor 15 to external electricity storage 26; Control buttons 18 are for manually operating electric motor 15 and lights 14; Motor-and-spindle coupling 19 is for coupling electric motor 15 and threaded spindle 20; Threaded spindle 20 is for raising and lowering spindle nut 4 and inner tube 3 when rotated by electric motor 15; Pulleys 21 are for allowing cables 22 to rest thereon to move up and down with ease when cables 22 are raised and lowered by inner tube 3, respectively; Cables 22 are for raising and lowering movable weighted strut bracket 5*b*; Cable tunnel 23 is for cables 22 to be threaded therethrough to connect cables 22 to inner tube 3; Remote control device 24 is for remotely operating electric motor 15 and lights 14; and Electric prong 25 is for being plugged into electric port. 17 to supply electricity from external electricity storage 26 to electric motor 15, in case battery 13 runs out of electricity.

Operation

Figure 5:
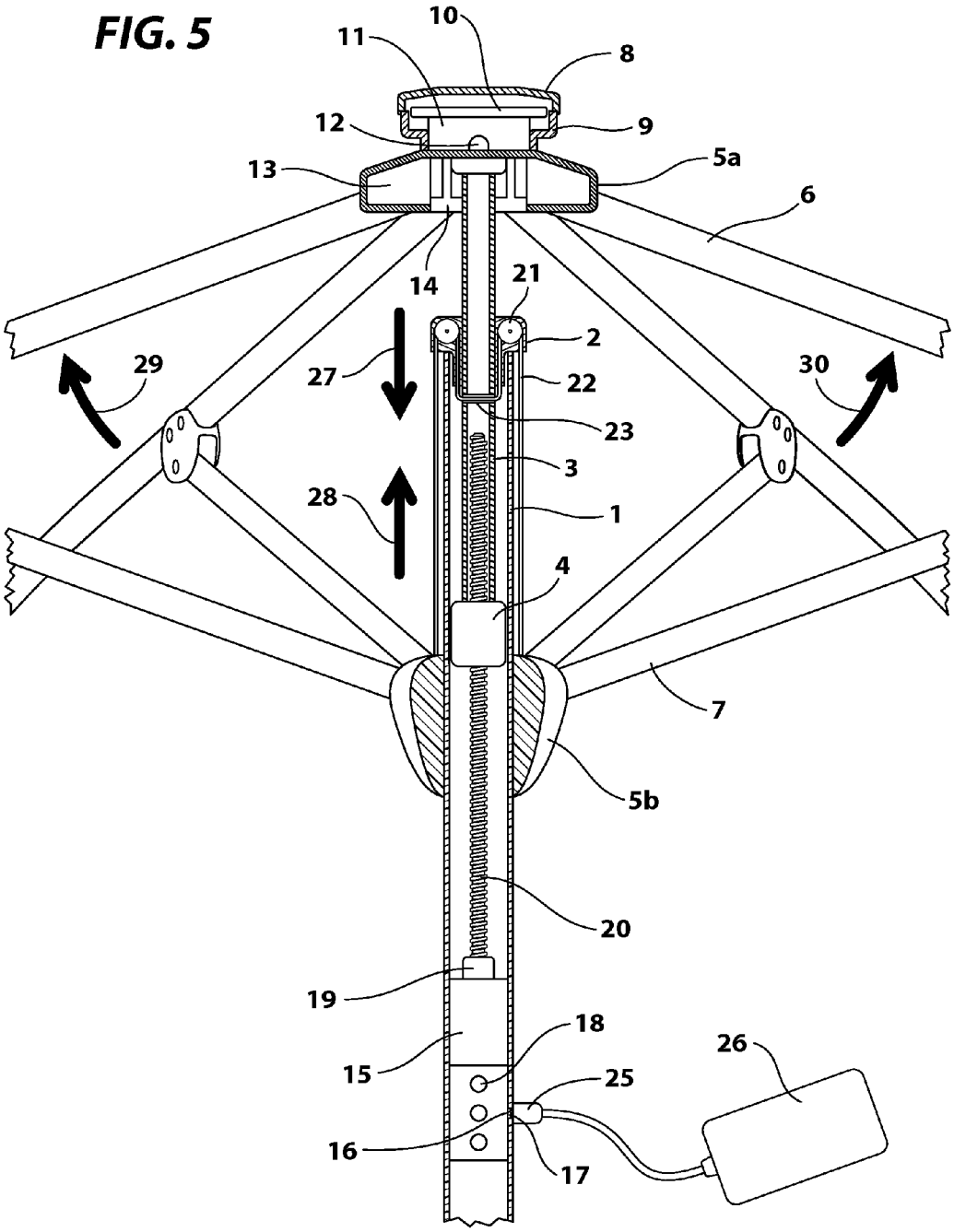
FIG. 5 illustrates the unique methods of reducing 50% of the required travel distance of the rib and strut predeterminedly weighted brackets of the umbrella, and eliminating the roughness of the operation of the umbrella.

1) How to unfold the unique solar-powered, pulley-assisted, simultaneously-and-oppositely-movable-top-and-bottom-weighted-bracket umbrella while reducing 50% of the required travel distance of weighted rib bracket. 5*a* and weighted strut bracket 5*b*, and while reducing 50% of the required time to unfold the umbrella:

Referring to FIGS. 1 and 5, the operation of the unique solar-powered, pulley-assisted, simultaneously-and-oppositely-movable-top-and-bottom-weighted-bracket umbrella comprises the step of pushing one of control buttons 18 or one of control buttons on remote control device 24 to rotate electric motor 15 to rotate spindle 20, in a counter-clockwise direction, to lower spindle nut 4 and inner tube 3. This, in turn, pulls weighted rib bracket 5*a* downward and pulls weighted strut bracket 5*b* upward via cables 22, simultaneously, in two opposite directions of arrows 27 and 28, respectively, which reduces 50% of the required travel distance of weighted rib bracket 5*a* and weighted strut bracket 5*b*. This, in turn, unfolds canopy ribs 6 and canopy struts 7, in the directions of arrows 29 and 30. The predetermined weights of weighted rib bracket 5*a* and weighted strut bracket 5*b* increase the gravitational forces exerted thereon when weighted rib bracket 5*a* and weighted strut bracket 5*b* are moving, eliminating the roughness of the operation of the umbrella.

As a result of this (by simultaneously and oppositely moving both weighted rib and strut brackets 5*a* and 5*b*), the unique solar-powered, pulley-assisted, simultaneously-and-oppositely-movable-top-and-bottom-weighted-bracket umbrella:

a) Reducing 50% of the required travel distance of weighted rib bracket 5*a* and weighted strut bracket 5*b*, b) Reduces 50% of the required time to unfold the umbrella, c) Eliminating the roughness of the operation of the umbrella, and d) Integrate the gravitational force into weighted rib bracket 5*a* and weighted strut bracket 5*b* to reduce the required pushing and pulling forces of electric motor 15.

Figure 3:
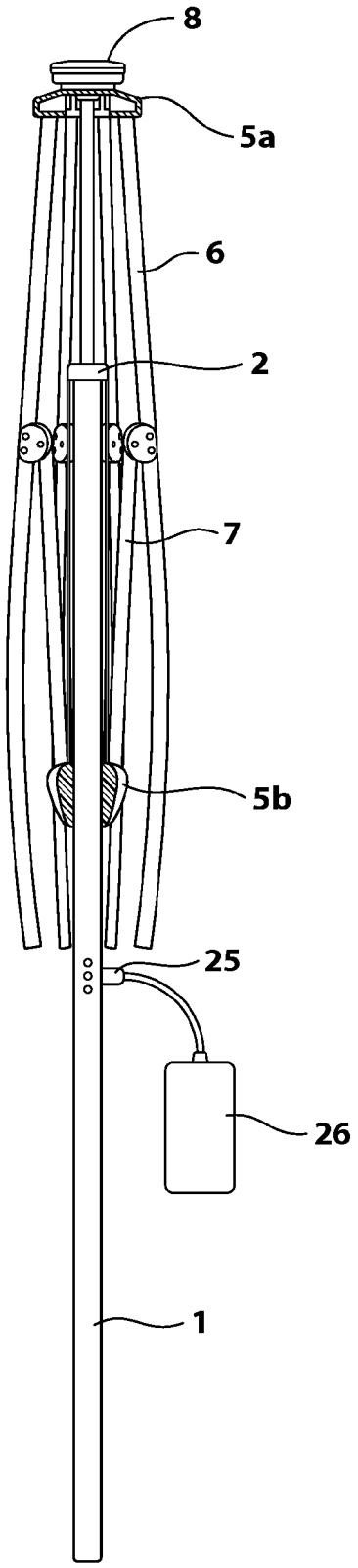
FIG. 3 illustrates a partially-cross-sectional view of the unique solar-powered, pulley-assisted, simultaneously-and-oppositely-movable-top-and-bottom-weighted-bracket umbrella, in a folded position.
Figure 4:
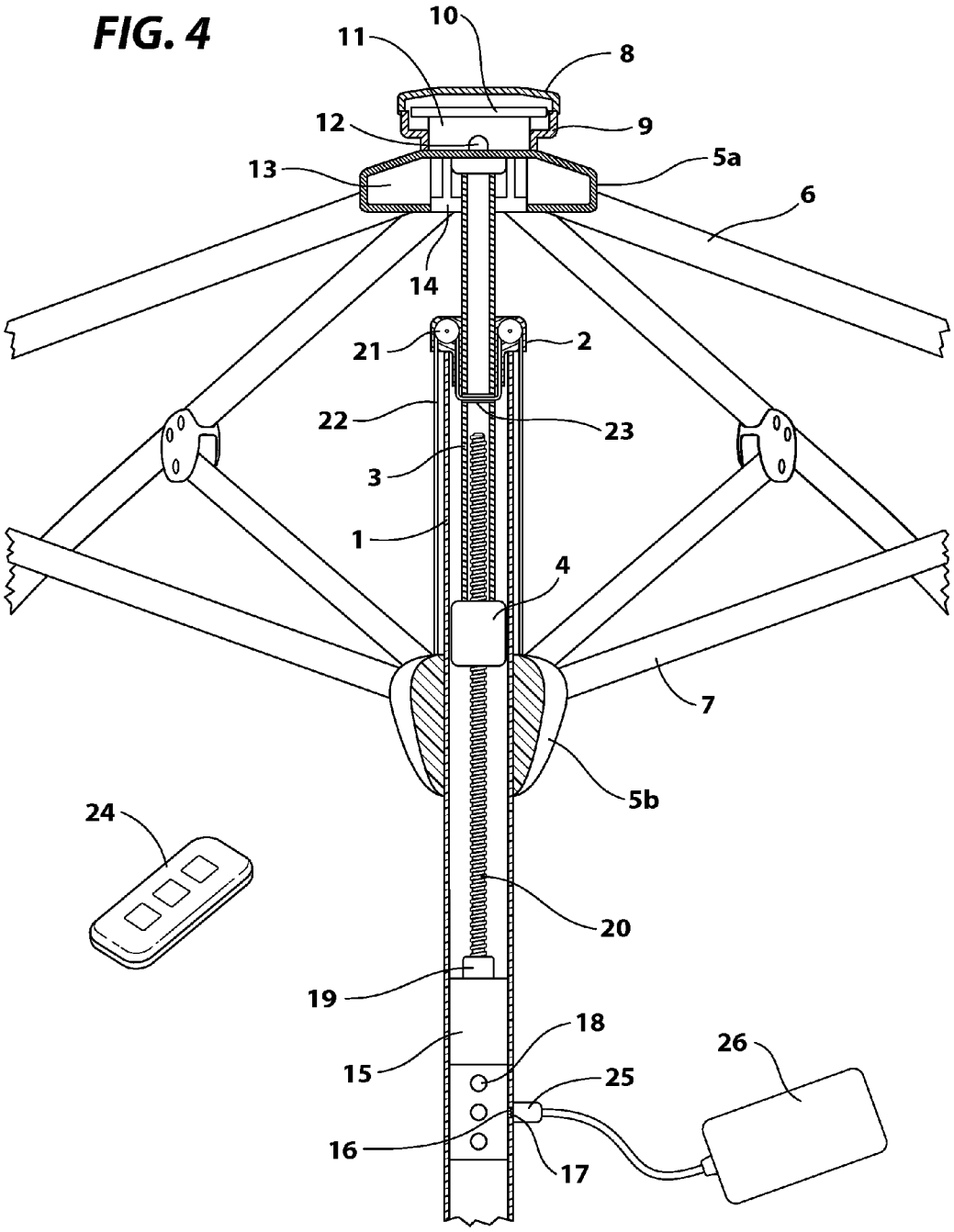
FIG. 4 illustrates a partially-cross-sectional view of the unique solar-powered, pulley-assisted, simultaneously-and-oppositely-movable-top-and-bottom-weighted-bracket umbrella, having a solar panel, pulleys, cables, and predeterminedly weighted rib and strut brackets.
Figure 6:
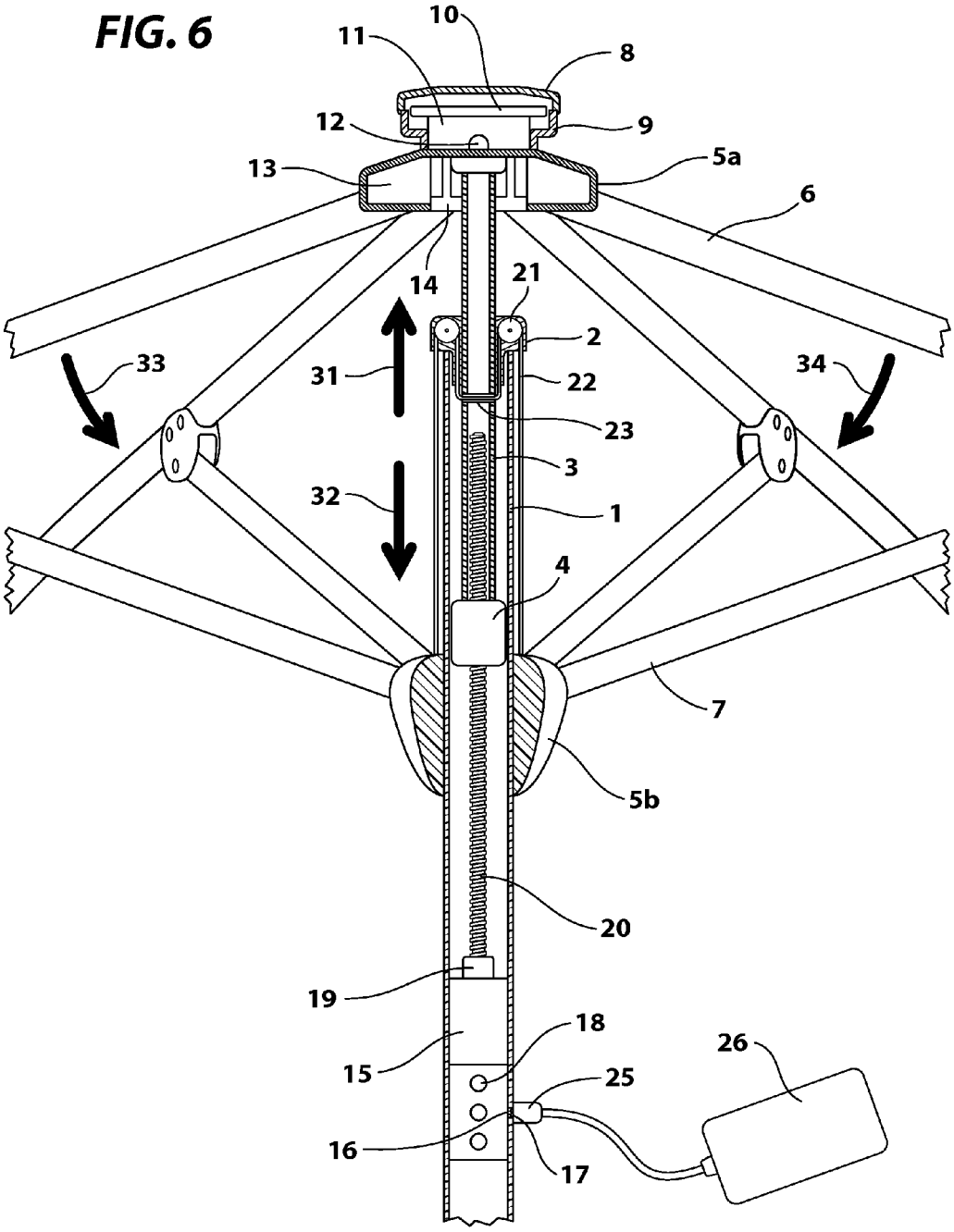
FIG. 6 illustrates the unique methods of reducing 50% of the required travel distance of the rib and strut predeterminedly weighted brackets of the umbrella, and eliminating the roughness of the operation of the umbrella.

2) How to fold the unique solar-powered, pulley-assisted, simultaneously-and-oppositely-movable-top-and-bottom-weighted-bracket umbrella while reducing 50% of the required travel distance of weighted rib bracket 5*a* and weighted strut bracket 5*b*, and while reducing 50% of the required time to fold the umbrella:

Referring to FIGS. 3 and 6 the operation of the unique solar-powered, pulley-assisted, simultaneously-and-oppositely-movable-top-and-bottom-weighted-bracket umbrella comprises the step of pushing one of control buttons 18 or one of control buttons on remote control device 24 to rotate electric motor 15 to rotate spindle 20, in a clockwise direction, to raise spindle nut 4 and inner tube 3. This in turn, pushes weighted rib bracket 5*a* upward and pushes weighted strut bracket 5*b* downward via cables 22, simultaneously, in two opposite directions of arrows 31 and 32, respectively, which reduces 50% of the required travel distance of weighted rib bracket 5*a* and weighted strut bracket 5*b*. This, in turn, folds up canopy ribs 6 and canopy struts 7, in the directions of arrows 33 and 34. The predetermined weights of weighted rib bracket 5*a* and weighted strut bracket 5*b* increase the gravitational forces exerted thereon when weighted rib bracket 5*a* and weighted strut bracket 5*b* are moving, eliminating the roughness of the operation of the umbrella.

As a result of this (by simultaneously and oppositely moving both weighted rib and strut brackets 5*a* and 5*b*), the unique solar-powered, pulley-assisted, simultaneously-and-oppositely-movable-top-and-bottom-weighted-bracket umbrella:

a) Reducing 50% of the required travel distance of weighted rib bracket 5*a* and weighted strut bracket 5*b*, b) Reduces 50% of the required time to fold the umbrella.

c) Eliminating the roughness of the operation of the umbrella, and d) Integrate the gravitational force into weighted rib bracket 5*a* and weighted strut bracket 5*b* to reduce the required pushing and pulling forces of electric motor 15.

Variation

Each component of the unique solar-powered, pulley-assisted, simultaneously-and-oppositely-movable-top-and-bottom-weighted-bracket umbrella can be a variation, as follows:

Outer tube 1 of the unique solar-powered, pulley-assisted, simultaneously-and-oppositely-movable-top-and-bottom-weighted-bracket umbrella can have any shape and length.

Fixed pulley bracket 2 of the unique solar-powered, pulley-assisted, simultaneously-and-oppositely-movable-top-and-bottom-weighted-bracket umbrella can have any shape and length.

Inner tube 3 of the unique solar-powered, pulley-assisted, simultaneously-and-oppositely-movable-top-and-bottom-weighted-bracket umbrella can have any shape and length.

Movable weighted rib bracket 5*a* and movable weighted strut bracket 5*b* of the unique solar-powered, pulley-assisted, simultaneously-and-oppositely-movable-top-and-bottom-weighted-bracket umbrella can each have any shape, size, and weight.

Figure 7:
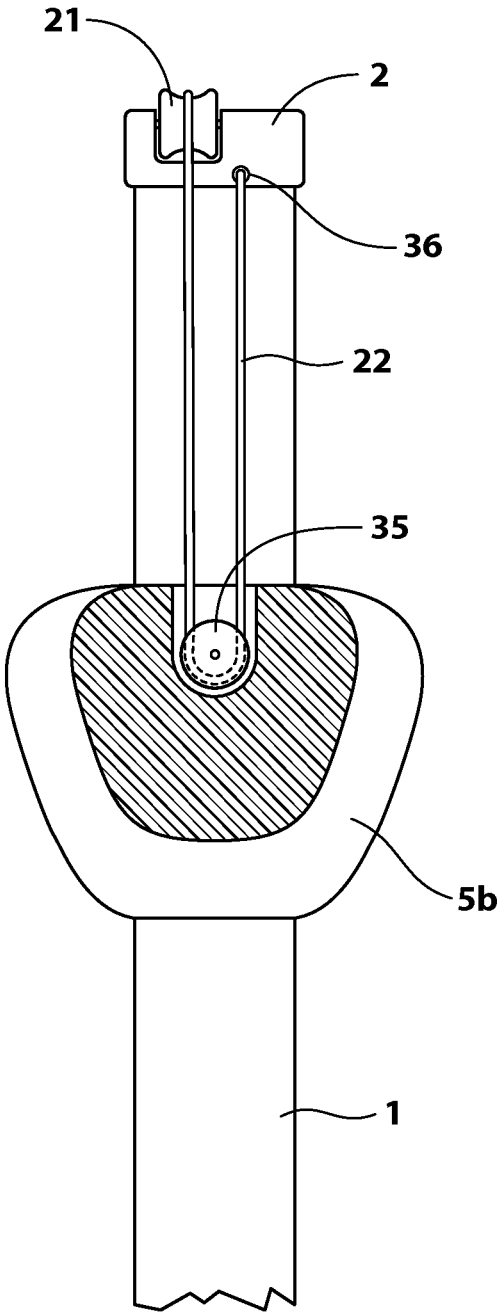
FIG. 7 illustrates a partial, perspective view of a tandem-pulley-system variation of the unique solar-powered, pulley-assisted, simultaneously-and-oppositely-movable-top-and-bottom-weighted-bracket umbrella, which reduces 50% of the required rotating force of the motor of the umbrella.

Referring to FIG. 7, further, the unique solar-powered, pulley-assisted, simultaneously-and-oppositely-movable-top-and-bottom-weighted-bracket umbrella, can comprise a plurality of additional pulleys 35, each of which is attached to movable weighted strut bracket 5*b* at a predetermined location thereon. Each end 36 of each of cables 22: a) is threaded under and around one of additional pulleys 35, and b) is attached to pulley bracket 2, to be secured thereto. As a result of this, the tandem-pulley system of pulleys 21 and additional pulleys 35 helps reduce 50% of the pulling forces required to pull weighted strut bracket 5*b* upward.

OBJECTS AND ADVANTAGES OF THE INVENTION

The unique solar-powered, pulley-assisted, simultaneously-and-oppositely-movable-top-and-bottom-weighted-bracket umbrella overcomes all the disadvantages of the prior art heretofore. The unique solar-powered, pulley-assisted, simultaneously-and-oppositely-movable-top-and-bottom-weighted-bracket umbrella substantially departs from the conventional concepts and designs of the prior art. In doing so, the unique solar-powered, pulley-assisted, simultaneously-and-oppositely-movable-top-and-bottom-weighted-bracket umbrella provides many unique, significant advantages, some of which are, as follows:

1) it is an object of the present invention to provide a unique solar-powered, pulley-assisted, simultaneously-and-oppositely-movable-top-and-bottom-weighted-bracket umbrella, which can substantially reduce 50% of the time required to fold and unfold the motorized umbrella, electrically, by using simultaneously and oppositely movable top-and-bottom weighted brackets.

2) it is an object of the present invention to provide a unique solar-powered, pulley-assisted, simultaneously-and-oppositely-movable-top-and-bottom-weighted-bracket umbrella, which can substantially reduce 50% of the up-and-down travel distance of the top and bottom weighted brackets required to fold and unfold the motorized umbrella, by moving the top and bottom weighted brackets, simultaneously and oppositely in the opposite directions.

3) It is an object of the present invention to provide a unique solar-powered, pulley-assisted, simultaneously-and-oppositely-movable-top-and-bottom-weighted-bracket umbrella, which can substantially reduce 50% of the amount of wear and tear exerted upon the components of the umbrella while folding and unfolding the motorized umbrella, by replacing the top and bottom unweighted brackets of the prior art with predeterminedly weighted top and bottom brackets, respectively.

4) it is another object of the present invention to provide a unique solar-powered, pulley-assisted, simultaneously-and-oppositely-movable-top-and-bottom-weighted-bracket umbrella, which can eliminate the umbrella-operating roughness caused by the top and bottom unweighted brackets of the prior art while they are moving up and down, by replacing them with predeterminedly weighted top and bottom brackets, respectively.

5) It is another object of the present invention to provide a unique solar-powered, pulley-assisted, simultaneously-and-oppositely-movable-top-and-bottom-weighted-bracket umbrella, which can integrate the gravitational force into the pushing and pulling forces of the motor of the umbrella during the folding and unfolding of the umbrella, by using predeterminedly weighted top and bottom brackets.

6) It is another object of the present invention to provide a unique solar-powered, pulley-assisted, simutaneously-and-oppositely-movable-top-and-bottom-weighted-bracket umbrella, which can substantially reduce 50% of the up-and-down travel distance of the inner tube of the umbrella, required to fold and unfold the motorized umbrella, to allow the umbrella to be able to be made taller.

7) It is an object of the present invention to provide a unique solar-powered, pulley-assisted, simultaneously-and-oppositely-movable-top-and-bottom-weighted-bracket umbrella, which can substantially reduce the amount of electricity required to fold and unfold the motorized umbrella, with the integration of the gravitational force thereinto.

8) It is another object of the present invention to provide a unique solar-powered, pulley-assisted, simultaneously-and-oppositely-movable-top-and-bottom-weighted-bracket umbrella, which can substantially decrease the umbrella-operating unreliability caused by the top and bottom brackets of the prior art while they are moving up and down, by replacing them with predeterminedly weighted top and bottom brackets, respectively, to extend the service lifespan of the umbrella.

9) It is another object of the present invention to provide a unique solar-powered, pulley-assisted, simultaneously-and-oppositely-movable-top-and-bottom-weighted-bracket umbrella, which can reduce 50% of the weights of the weighted rib and strut brackets to substantially reduce the power and size of its motor required to fold and unfold the umbrella, with the integration of the gravitational force thereinto.

10) It is another object of the present invention to provide a unique solar-powered, pulley-assisted, simultaneously-and-oppositely-movable-top-and-bottom-weighted-bracket umbrella, which can substantially be made larger while using its motor of the same power and size.

As a result, the unique solar-powered, pulley-assisted, simultaneously-and-oppositely-movable-top-and-bottom-weighted-bracket umbrella overcomes all the disadvantages of the prior art.

What is claimed is:

1. A row-pulley-system-assisted, solar-powered, simultaneously-and-oppositely-movable-top-and-bottom-weighted-bracket umbrella comprising:

an outer tube;

a pulley bracket, said outer tube having an outer-tube upper end, said pulley bracket attached to the outer-tube upper end of said outer tube;

an inner tube, said pulley bracket having a central hole along its longitudinal axis, said inner tube inserted through the central hole of said pulley bracket into said outer tube such that said pulley bracket centers said inner tube therein;

a spindle nut, said inner tube having an inner-tube lower end, said spindle nut attached to the inner-tube lower end of said inner tube;

a weighted rib bracket, said weighted rib bracket predeterminedly weighted to integrate a predetermined gravitational force thereto, said inner tube having an inner-tube upper end, said weighted rib bracket attached to the inner-tube upper end of said inner tube;

a weighted strut bracket, said weighted strut bracket predeterminedly weighted to integrate a predetermined gravitational force thereto, said weighted strut bracket slid over said outer tube such that said weighted strut bracket is able to move up and down on said outer tube;

a plurality of canopy ribs each having a rib end, the rib ends of said canopy ribs pivotally attached to said weighted rib bracket;

a plurality of canopy struts each having first and second strut ends, the first strut ends of said canopy struts pivotally attached to said weighted strut bracket, the second strut ends of said canopy struts pivotally attached to said canopy ribs at predetermined locations thereon, respectively;

a transparent housing top for letting sun light to pass therethrough;

a housing bottom attached to said transparent housing top;

a solar panel for collecting energy from sun light;

a circuit-board control center attached to said solar panel;

a remote-control-device-signal receiver attached to said circuit-board control center, said transparent housing top and said housing bottom for protecting said solar panel, said circuit-board control center, and said remote-control-device-signal receiver;

a battery attached to said circuit-board control center, said battery for storing the electricity from solar panel;

a plurality of lights attached to said circuit-board control center for illuminating the ground area under the umbrella, said circuit-board control center attached to said housing bottom;

an electric motor attached to said circuit-board control center, said circuit-board control center for converting the solar energy absorbed by said solar panel into electricity and for regulating the operation and energy management of said electric motor;

an electric port attached to said electric motor;

a plurality of control buttons operatingly attached to said circuit-board control center to operate said lights and said electric motor;

a motor-and-spindle coupling;

a threaded spindle, said spindle nut having a central threaded hole along its longitudinal axis, said threaded spindle having a thread mated to the thread of the central hole of said spindle nut, said motor-and-spindle coupling having a coupling upper surface and a coupling under surface, said electric motor attached to the coupling under surface of said motor-and-spindle coupling, said threaded spindle attached to the coupling upper surface of said motor-and-spindle coupling, said threaded spindle screwed upward through the central threaded hole of said spindle nut;

a row-pulley system comprising a plurality of pulleys attached to said pulley bracket at predetermined locations thereon;

a plurality of cables for raising and lowering said weighted strut bracket; and a cable tunnel, said cables each having two cable ends, said inner tube having said cable tunnel, each of said cables threaded through said cable tunnel of said inner tube such that the cable ends of each of said cables are threaded through the central hole of said pulley bracket, pulled over two opposite ones of said pulleys, and attached to said weighted strut bracket on the two opposite sides thereof, wherein, said electric motor rotating when powered to rotate said spindle such that said rib and strut brackets are raised and lowered simultaneously in two opposite directions to fold or unfold said canopy ribs and struts to fold or unfold the umbrella, respectively.

2. The solar-powered, pulley-assisted, simultaneously-and-oppositely-movable-top-and-bottom-weighted-bracket umbrella of claim 1, further, comprising an external electricity-storing means for being plugged into said electric port to supply electricity to said electric motor.

3. The solar-powered, pulley-assisted, simultaneously-and-oppositely-movable-top-and-bottom-weighted-bracket umbrella of claim 1, further, comprising a remote control device having operating means for operating said lights and said electric motor from a remote location.

4. The solar-powered, pulley-assisted, simultaneously-and-oppositely-movable-top-and-bottom-weighted-bracket umbrella of claim 1, wherein, said inner tube comprising a cylindrical tube having a continuous cavity, through which said spindle can move up and down in the direction of its longitudinal axis.

5. The solar-powered, pulley-assisted, simultaneously-and-oppositely-movable-top-and-bottom-weighted-bracket umbrella of claim 1, wherein, said spindle attached to said motor-and-spindle coupling.

6. The solar-powered, pulley-assisted, simultaneously-and-oppositely-movable-top-and-bottom-weighted-bracket umbrella of claim 1, wherein, said electric motor attached to said motor-and-spindle coupling.

7. The solar-powered, pulley-assisted, simultaneously-and-oppositely-movable-top-and-bottom-weighted-bracket umbrella of claim 1, wherein, each of said canopy ribs having a generally circular cross-section.

8. The solar-powered, pulley-assisted, simultaneously-and-oppositely-movable-top-and-bottom-weighted-bracket umbrella of claim 1, wherein, each of said canopy struts having a generally circular cross-section.

9. The solar-powered, pulley-assisted, simultaneously-and-oppositely-movable-top-and-bottom-weighted-bracket umbrella of claim 1, wherein, each of said canopy ribs having a generally oval cross-section.

10. The solar-powered, pulley-assisted, simultaneously-and-oppositely-movable-top-and-bottom-weighted-bracket umbrella of claim 1, wherein, each of said canopy struts having a generally oval cross-section.

11. A tandem-pulley-system-assisted, solar-powered, simultaneously-and-oppositelymovable-top-and-bottom-weighted-bracket umbrella comprising:

an outer tube;

a pulley bracket, said outer tube having an outer-tube upper end, said pulley bracket attached to the outer-tube upper end of said outer tube;

an inner tube, said pulley bracket having a central hole along its longitudinal axis, said inner tube inserted through the central hole of said pulley bracket into said outer tube such that said pulley bracket centers said inner tube therein;

a spindle nut, said inner tube having an inner-tube lower end, said spindle nut attached to the inner-tube lower end of said inner tube;

a weighted rib bracket, said weighted rib bracket predeterminedly weighted to integrate a predetermined gravitational force thereto, said inner tube having an inner-tube upper end, said weighted rib bracket attached to the inner-tube upper end of said inner tube;

a weighted strut bracket, said weighted strut bracket predeterminedly weighted to integrate a predetermined gravitational force thereto, said weighted strut bracket slid over said outer tube such that said weighted strut bracket is able to move up and down on said outer tube;

a plurality of canopy ribs each having a rib end, the rib ends of said canopy ribs pivotally attached to said weighted rib bracket;

a plurality of canopy struts each having first and second strut ends, the first strut ends of said canopy struts pivotally attached to said weighted strut bracket, the second strut ends of said canopy struts pivotally attached to said canopy ribs at predetermined locations thereon, respectively;

a transparent housing top for letting sun light to pass therethrough;

a housing bottom attached to said transparent housing top;

a solar panel for collecting energy from sun light;

a circuit-board control center attached to said solar panel;

a remote-control-device-signal receiver attached to said circuit-board control center, said transparent housing top and said housing bottom for protecting said solar panel, said circuit-board control center, and said remote-control-device-signal receiver;

a battery attached to said circuit-board control center, said battery for storing the electricity from solar panel;

a plurality of lights attached to said circuit-board control center for illuminating the ground area under the umbrella, said circuit-board control center attached to said housing bottom;

an electric motor attached to said circuit-board control center, said circuit-board control center for converting the solar energy absorbed by said solar panel into electricity and for regulating the operation and energy management of said electric motor;

an electric port attached to said electric motor;

a plurality of control buttons operatingly attached to said circuit-board control center to operate said lights and said electric motor;

a motor-and-spindle coupling;

a threaded spindle, said spindle nut having a central threaded hole along its longitudinal axis, said threaded spindle having a thread mated to the thread of the central hole of said spindle nut, said motor-and-spindle coupling having a coupling upper surface and a coupling under surface, said electric motor attached to the coupling under surface of said motor-and-spindle coupling, said threaded spindle attached to the coupling upper surface of said motor-and-spindle coupling, said threaded spindle screwed upward through the central threaded hole of said spindle nut;

a tandem-pulley-system comprising:

a plurality of top pulleys attached to said pulley bracket at predetermined locations thereon, a plurality of bottom pulleys attached to said weighted strut bracket at predetermined locations thereon;

a plurality of cables for raising and lowering said weighted strut bracket; and a cable tunnel, said cables each having two cable ends, said inner tube having said cable tunnel, each of said cables threaded through said cable tunnel of said inner tube such that the cable ends of each of said cables are threaded through the central hole of said pulley bracket, pulled over two opposite ones of said top pulleys, pulled under two opposite ones of said bottom pulleys, and attached to said pulley bracket on the two opposite sides thereof, wherein, said electric motor rotating when powered to rotate said spindle such that said rib and strut brackets are raised and lowered simultaneously in two opposite directions to fold or unfold said canopy ribs and struts to fold or unfold the umbrella, respectively.

12. The solar-powered, pulley-assisted, simultaneously-and-oppositely-movable-topand-bottom-weighted-bracket umbrella of claim 11, further, comprising an external electricity-storing means for being plugged into said electric port to supply electricity to said electric motor.

13. The solar-powered, pulley-assisted, simultaneously-and-oppositely-movable-top-and-bottom-weighted-bracket umbrella of claim 11, further, comprising a remote control device having operating means for operating said lights and said electric motor from a remote location.

14. The solar-powered, pulley-assisted, simultaneously-and-oppositely-movable-top-and-bottom-weighted-bracket umbrella of claim 11, wherein, each of said canopy ribs having a generally oval cross-section.

15. The solar-powered, pulley-assisted, simultaneously-and-oppositely-movable-top-and-bottom-weighted-bracket umbrella of claim 11, wherein, each of said canopy struts having a generally oval cross-section.

16. The solar-powered, pulley-assisted, simultaneously-and-oppositely-movable-top-and-bottom-weighted-bracket umbrella of claim 11, wherein, said electric motor attached to said motor-and-spindle coupling.

17. The solar-powered, pulley-assisted, simultaneously-and-oppositely-movable-top-and-bottom-weighted-bracket umbrella of claim 11, wherein, each of said canopy ribs having a generally circular cross-section.

18. The solar-powered, pulley-assisted, simultaneously-and-oppositely-movable-top-and-bottom-weighted-bracket umbrella of claim 11, wherein, said inner tube comprising a cylindrical tube having a continuous cavity, through which said spindle can move up and down in the direction of its longitudinal axis.

19. The solar-powered, pulley-assisted, simultaneously-and-oppositely-movable-top-and-bottom-weighted-bracket umbrella of claim 11, wherein, said spindle attached to said motor-and-spindle coupling.

20. The solar-powered, pulley-assisted, simultaneously-and-oppositely-movable-top-and-bottom-weighted-bracket umbrella of claim 11, wherein, each of said canopy struts having a generally circular cross-section.

* * * * *